US005690213A

United States Patent [19]

Matsumura

[11] Patent Number: 5,690,213

[45] Date of Patent: Nov. 25, 1997

[54] COMBINATION SHIPPING AND DISPLAY CARTON

[75] Inventor: Yuji Matsumura, Boulder, Colo.

[73] Assignee: Shoyeido Corporation, Boulder, Colo.

[21] Appl. No.: 696,591

[22] Filed: Aug. 16, 1996

[51] Int. Cl.[6] ..... B65D 5/44

[52] U.S. Cl. ..... 206/45.21; 206/45.23; 206/774

[58] Field of Search ..... 206/45.2, 45.21, 206/45.23, 738, 774, 736

[56] References Cited

U.S. PATENT DOCUMENTS

| | | | |
|---|---|---|---|
| 1,125,987 | 1/1915 | Eichhorn . | |
| 1,213,135 | 1/1917 | Kislovitz . | |
| 1,234,421 | 7/1917 | Tinsley . | |
| 1,536,949 | 5/1925 | Tinsley . | |
| 1,860,309 | 5/1932 | Davidson | 206/45.21 |
| 2,294,965 | 9/1942 | Davidson | 206/45.21 |
| 2,675,913 | 4/1954 | Hanson . | |
| 2,835,378 | 5/1958 | Sramek . | |
| 3,185,293 | 5/1965 | Fletcher . | |
| 3,219,181 | 11/1965 | Dahm | 206/45.21 |
| 4,197,939 | 4/1980 | Dogliotti | 206/44 R |
| 4,696,397 | 9/1987 | Nakamats | 206/444 |
| 5,007,530 | 4/1991 | Weismantel | 206/45.21 |

*Primary Examiner*—Jacob K. Ackun

*Attorney, Agent, or Firm*—Greenlee, Winner, and Sullivan P.C.

[57] ABSTRACT

A carton for shipping and displaying articles for sale. The shipping carton is converted to a display by removing and discarding an upper portion and folding a part of the remaining lower portion under the floor of the carton to form a base for tilting the carton. The carton is folded from a single blank and all exterior surfaces of the carton, and the front and side exterior surfaces of the display, can be finished on one side of the blank.

9 Claims, 9 Drawing Sheets

COMBINATION SHIPPING AND DISPLAY CARTON

This invention relates to a special package, convertible to a display, for shipping and displaying merchandise.

BACKGROUND OF THE INVENTION

It is often desirable for a merchant to receive merchandise shipped from the manufacturer in a carton suitable for displaying the merchandise in a manner attractive to the customer. Using a single carton for both the shipping and displaying functions is economical of manufacturing labor and materials as well as labor and space for waste disposal. The merchant is relieved of the need to design and implement a display arrangement. And, the manufacturer is able to produce a carton with an attractive and recognizable design or trademark which is consistent among all the merchants handling that merchandise.

Cartons combining the functions of shipping and displaying products have been known in the art for more than 80 years. U.S. Pat. Nos. 1,125,987 to Eichorn, 1,213,135 to Kislovitz, 1,234,421 and 1,536,949 to Tinsley, 2,835,378 to Sramek, and 3,185,293 to Fletcher all describe display cartons having low walls in which the floor is tilted forward toward the customer when the carton is adapted for display. While the forward-tilting floor is desirable for displaying short stocky items of merchandise, for tall slender items it is preferable to have a container with a high back wall and a backward-tilting floor. In the latter configuration, gravity tends to move the items in a partially empty carton to the rear where they are cradled and held upright by the back wall thereby providing a neat and organized appearance.

U.S. Pat. No. 2,294,965 to Davidson describes a tall, narrow and deep carton having the conventional box construction of four flaps folded to form each of the top and bottom surfaces of the carton. The carton has an indicia line (or a severable line) extending diagonally across each side of the carton from each top rear corner (below the upper rear flap) to a point part of the way down on each vertical edge of the front surface. Each line then continues from that point down the vertical edge to another point near the bottom of the carton. The first two points are at the same height and the second two points are at the same height. By cutting the carton along the indicia lines and folding along a first line connecting the first two points and a second line connecting the second two points, the top portion of the carton can be folded forward and inverted under the bottom portion thereby forming a base which allows the bottom portion, now open at the top and over a portion of the front surface, to tilt backward slightly from the horizontal.

U.S. Pat. No. 2,675,913 to Hanson describes a carton similar to U.S. Pat. No. 2,294,965 but in which the lines of severance are curved instead of straight diagonals and are partially cut during manufacture to enable easy separation when the carton is made ready for display. Also, relative to U.S. Pat. No. 2,294,965, the cuts and fold lines are interchanged front to rear and top to bottom in such a way as to permit the top portion of the carton to be folded backward and inverted under the bottom portion to form a base which allows the bottom portion to tilt backward slightly from the horizontal. The carton is folded from a blank cut from single flat sheet of material and finished with a single glued surface. It is held expanded by the use of tabs instead of glue or staples.

While the cartons described in U.S. Pat. Nos. 2,294,965 and 2,675,913 provide the functions of supporting and displaying tall slender items, they are complex in construction and have high side walls which partially obscure the items of merchandise. When the carton of U.S. Pat. No. 2,294,965 is in the display configuration, an interior surface of the carton becomes the front face of the display. An interior surface can be unsightly unless the blank is printed on both sides, which is an additional cost. When converting the carton of U.S. Pat. No. 2,675,913 to a display, it can be difficult to thrust the lower portion into the upper portion if the upper and lower portions of are of equal width. Although it is possible to make a carton in which the top is wider than the bottom, such a carton can have disadvantages in manufacturing and shipping. Also, the carton of U.S. Pat. No. 2,675,913 becomes deeper when converted to a display and takes up more shelf space.

SUMMARY OF THE INVENTION

This invention provides two improvements over the prior art. First, an upper portion of the carton is removed when the carton is prepared for display. By removing a portion of the carton, more of the product is made visible to the customer without increasing the height or depth of the display or obscuring any part of the remaining front or sides of a decorative carton. Second, the easel, or base of the display, is formed from a single sheet of material which permits a simpler and less precise construction of the carton. In the preferred embodiment, the base is formed by folding the lid to the rear and under the carton. By folding the lid to the rear, the remaining front panel is not obscured when the carton is converted to a display and the visible front and side exterior surfaces can be formed from a single finished side of the blank. Also, the carton has equal width at the top and bottom and requires no additional shelf space when converted to a display. These improvements provide for more attractive displays and for lower costs for both the manufacturer and the merchant.

DESCRIPTION OF THE PREFERRED EMBODIMENT

Figure 1:
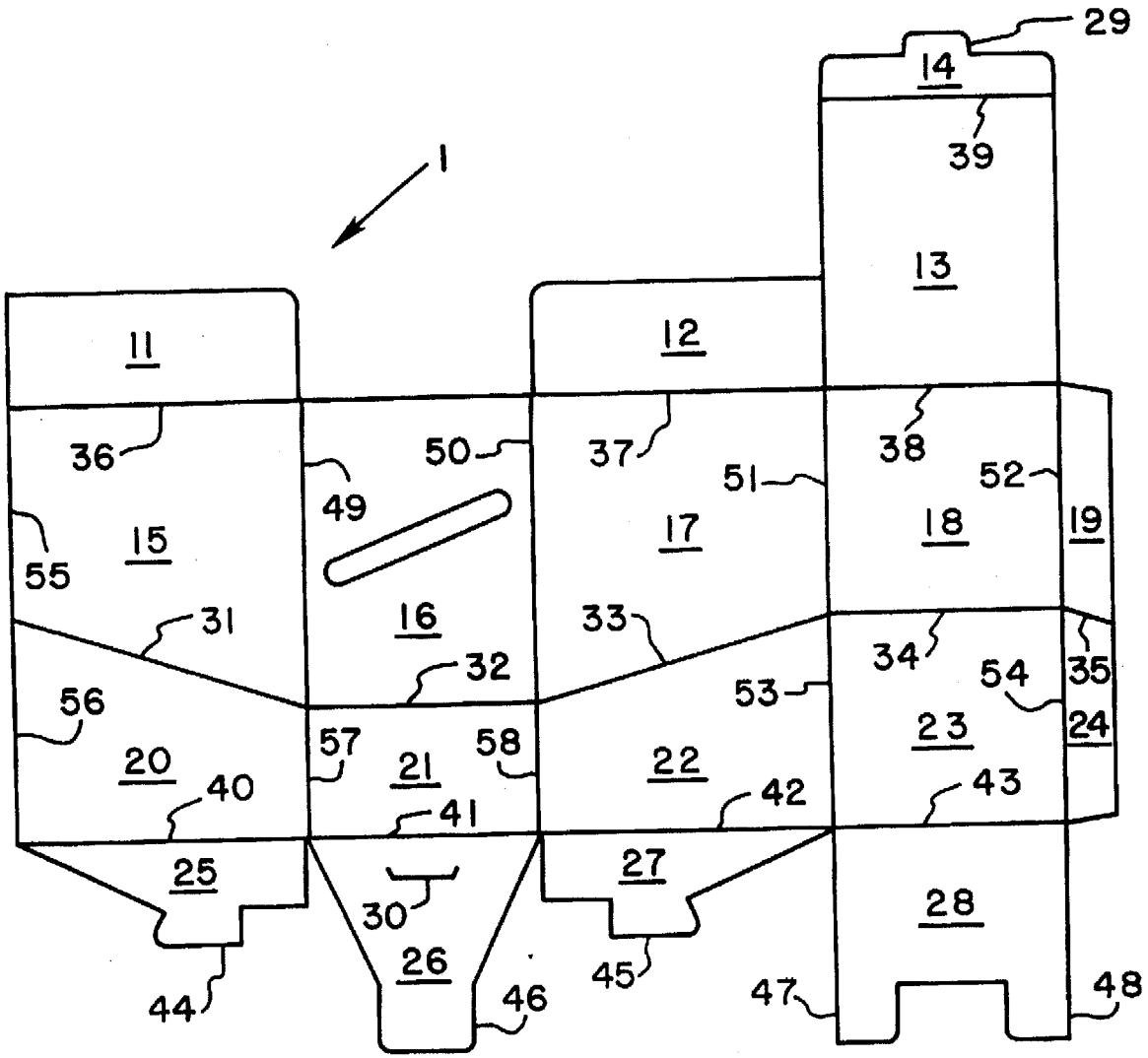
FIG. 1 shows the preferred embodiment of the carton in its unfolded (blank) state.

A plan view of a blank (cut but unfolded form) of the carton is shown in FIG. 1. The blank comprises panels 11–28 having fold lines 34, 36–43, 49–54 and 57–58. The blank also has perforated lines 31–33, 35, 51 and 52. Lines 51 and 52 are perforated fold lines. Panel 14 has a base tab 29 and panel 26 has a tab slot 30 for receiving base tab 29. Panels 25–28 have interlocking tabs 44–48.

Figure 2:
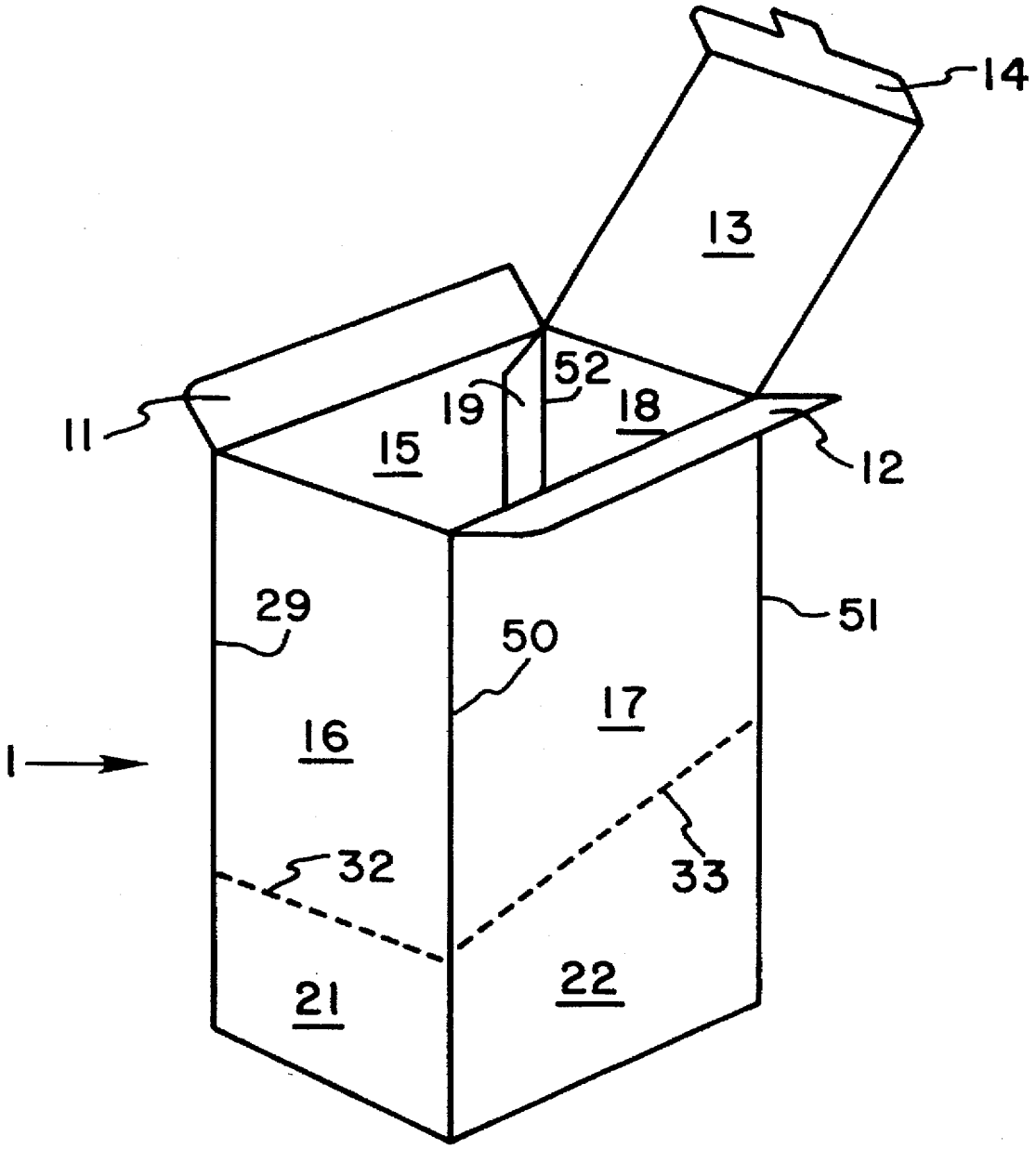
FIG. 2 shows the preferred embodiment in its shipping configuration.

To form the shipping carton 1, shown in FIG. 2, the blank of FIG. 1 is folded with a 90° angle along each of fold lines 49–57, 50–58, 51–53, and 52–54. The directions of the folds are such that panels 19 and 24 can be attached or bonded to panels 15 and 20 respectively while fold lines 52 and 54 are aligned with edges 55 and 56 respectively. When the carton is assembled, panels 16 and 21 form upper and lower front panels. Panels 18 and 23 form upper and lower rear panels. Panels 15 and 20, along with attached panels 19 and 24, form upper and lower left side panels. Panels 17 and 22 form upper and lower right side panels. Panel 13 forms the base panel which functions as a lid in the shipping configuration and a base in the display configuration. Panel 14 forms a tab panel. The floor of the carton is formed by folding panels 25–28 inwardly along fold lines 40–43. Panel 28 is folded first, then panels 25 and 27 followed by panel 26. Tabs 44 and 45 extend inwardly through the opening in panel 28 between tabs 47 and 48. When panel 26 is folded, tab 46 is pushed inwardly through the opening between tabs 47 and 48, covering tabs 44 and 45, and interlocking the four panels 25–28 into a solid floor for the container. The carton 1 is shown assembled, with its top open, in FIG. 2. The carton 1 is closed by folding panels 11 and 12, then panel 14 followed by panel 13, all inwardly along fold lines 36–39. Fold lines 36–39 function as hinges for hingedly attaching panels 11–14 to panels 15, 17, 18 and 13 respectively.

Figure 3:
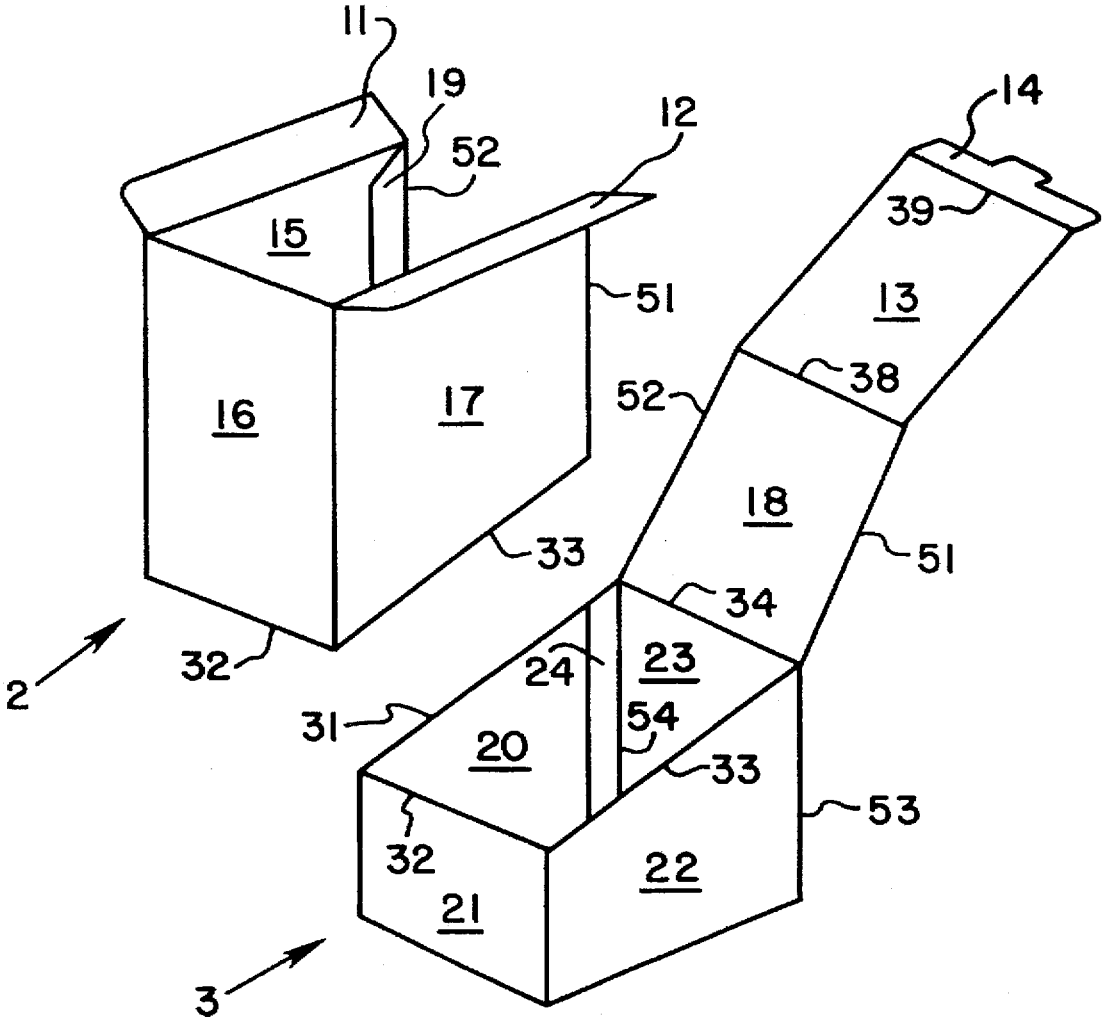
FIG. 3 shows the preferred embodiment being prepared for display.
Figure 4:
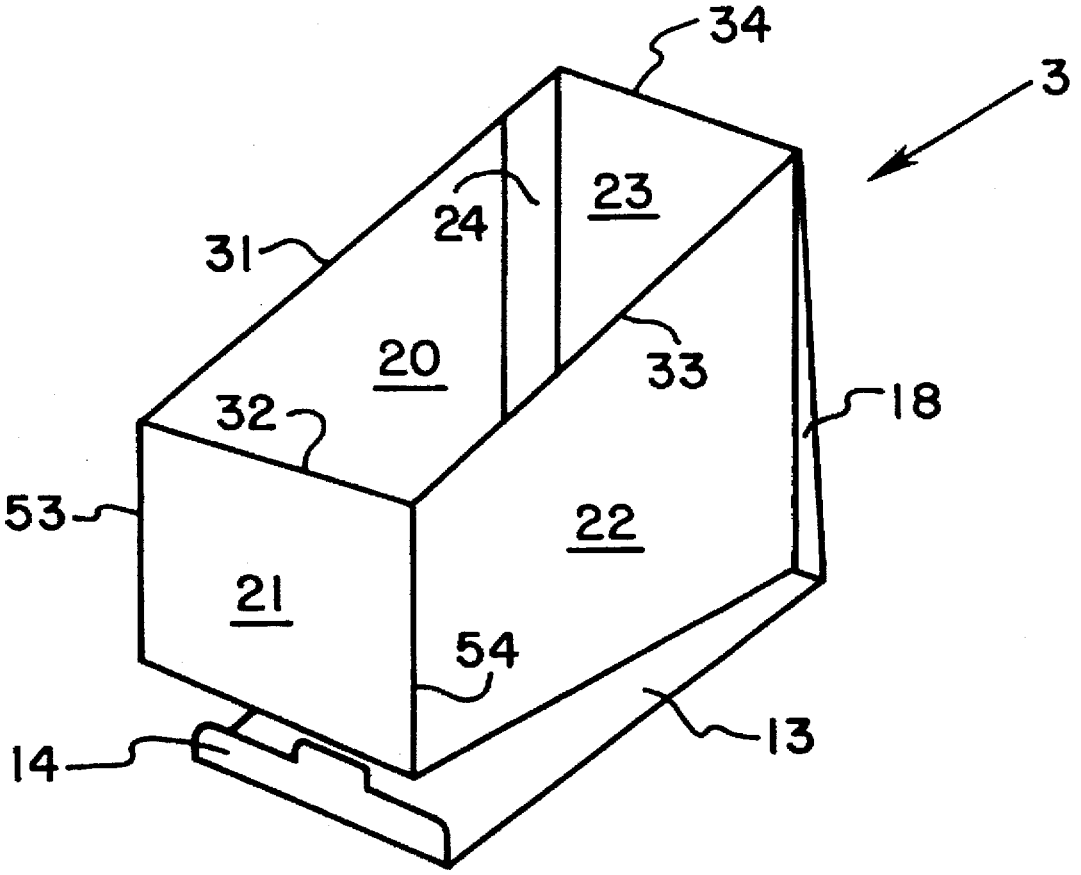
FIG. 4 shows the preferred embodiment in its display configuration.

To prepare the carton for display, as shown in FIG. 3 the upper portion 2 of the carton, comprising panels 11, 12, 15–17 and 19, is separated from the lower portion 3 along perforated lines 31–33, 51 and 52 and discarded. Then panels 13 and 14 are folded outwardly along fold lines 38 and 39. The preparation is completed, as shown in FIG. 4, by folding panel 18 outwardly along fold line 34 and inserting base tab 29 into tab slot 30 (FIG. 1).

Figure 5:
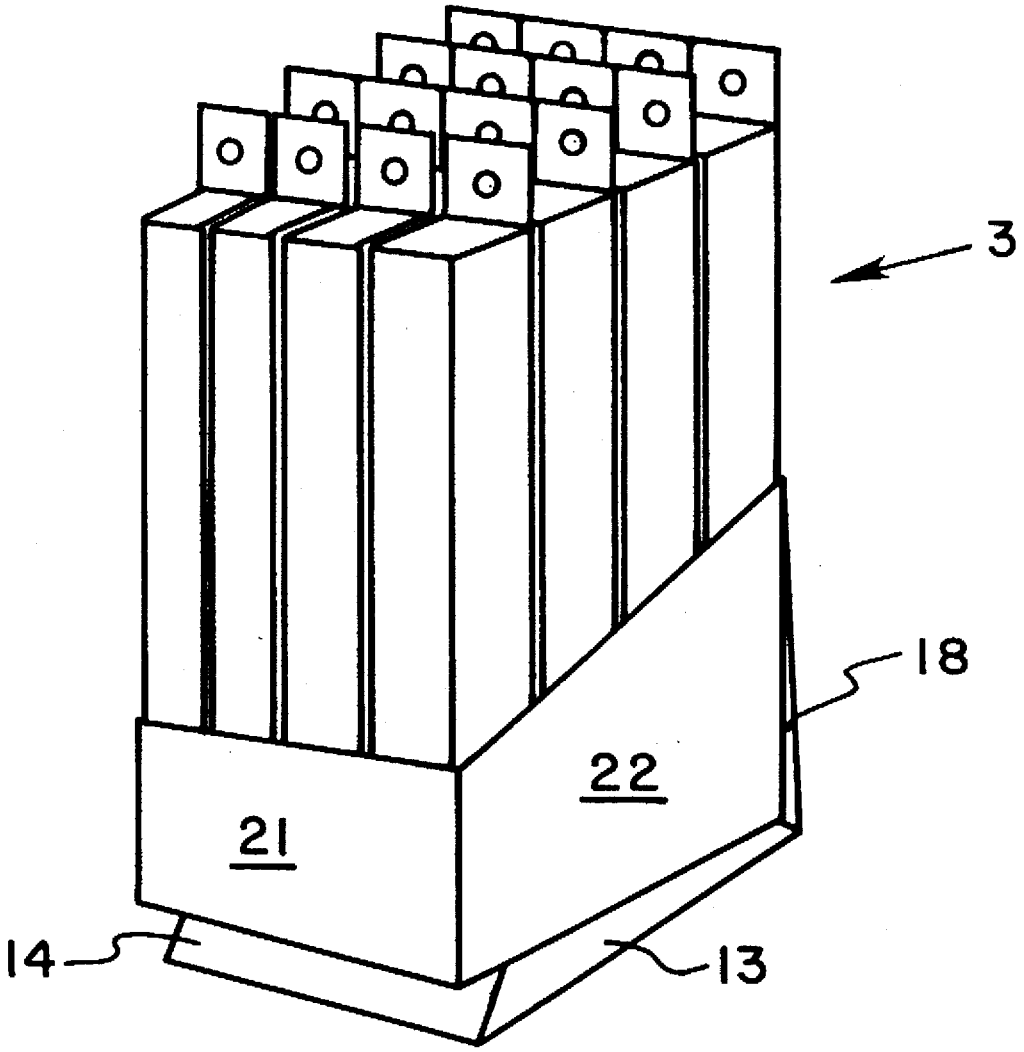
FIG. 5 shows the preferred embodiment displaying its contents.

FIG. 5 shows the converted carton in use displaying typical articles of merchandise.

Figure 7:
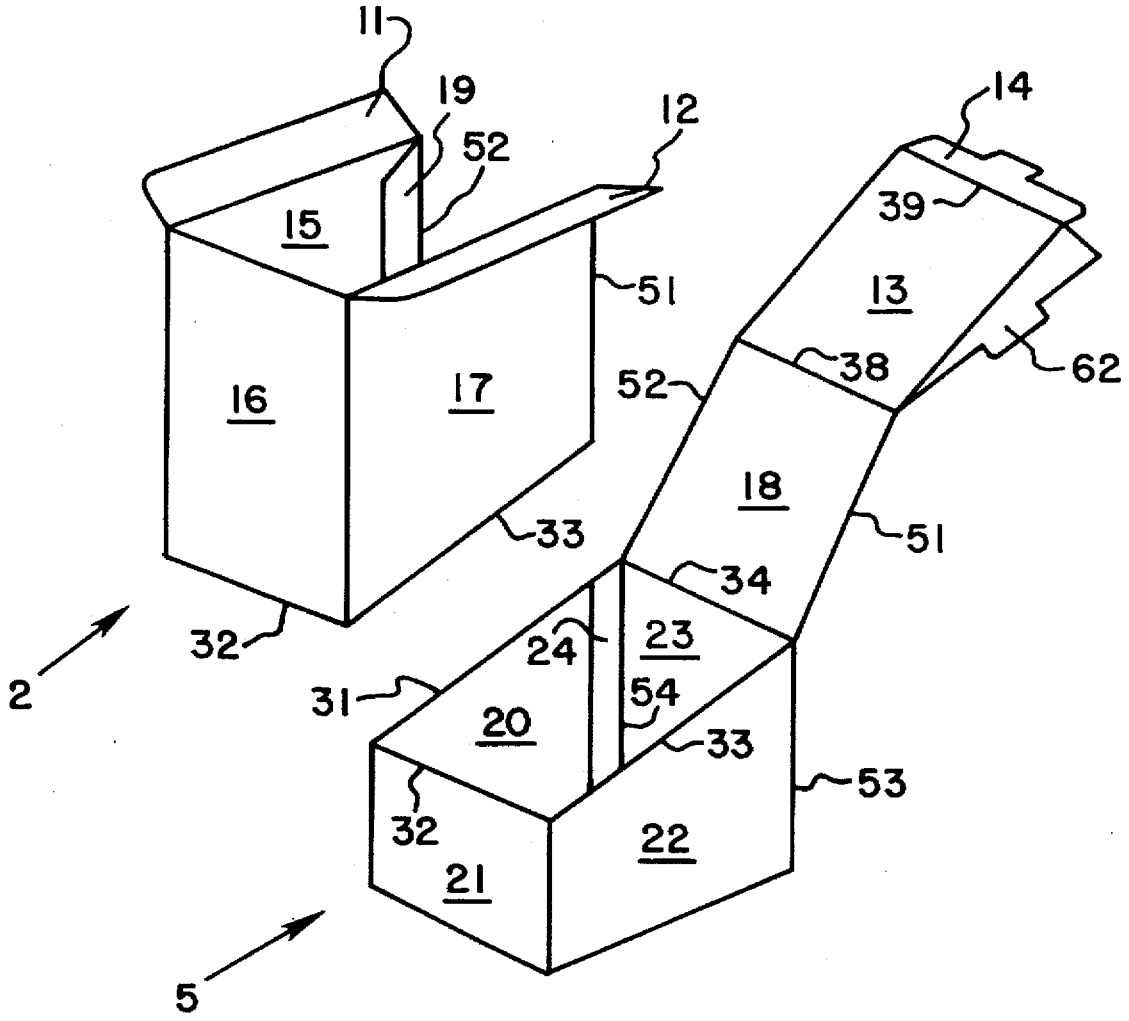
FIGS. 6–8 show an embodiment with a different rear-folding base configuration.
Figure 6:
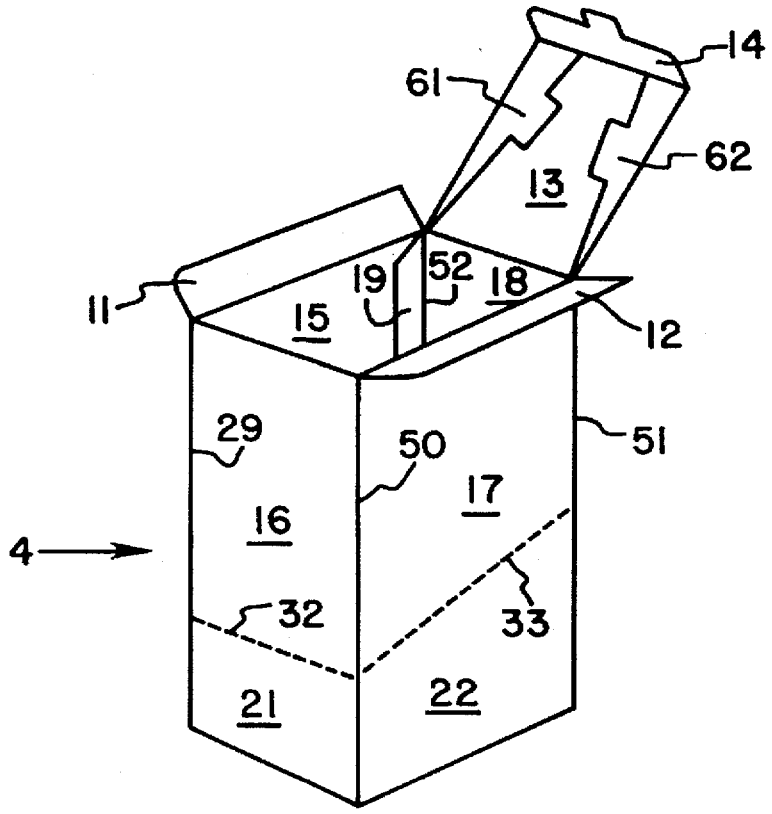
Figure 8:
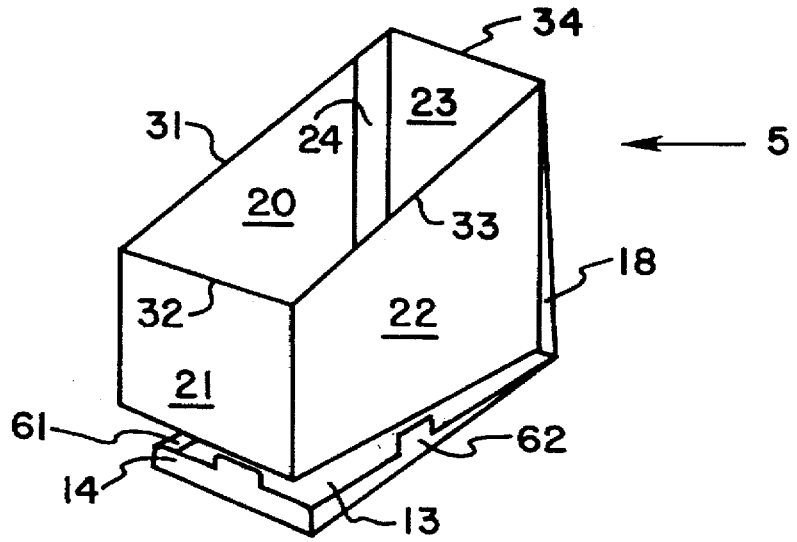

While the preceding describes the preferred embodiment, various changes may be obvious to those of ordinary skill in the art. For example, the base for tilting the carton can be formed in different ways. Referring to carton 4 of FIG. 6, side tab panels 61 and 62 can be added to panel 13 and folded flat against it in the shipping configuration. Each of side tab panels 61 and 62 has a tab attached. Two tab slots are added along fold lines 40 and 42 of FIG. 1. As shown in FIG. 7, when upper portion 2 of the carton is removed from lower portion 5, panels 61 and 62 remain with the lower portion. Then, as shown in FIG. 8, when panel 13 is folded under lower portion 5, panels 61 and 62 (in addition to panel 14) are folded upward and the attached tabs are inserted into the added side tab slots. This embodiment provides a more rigid support for the carton when it is converted to a display.

Figure 10:
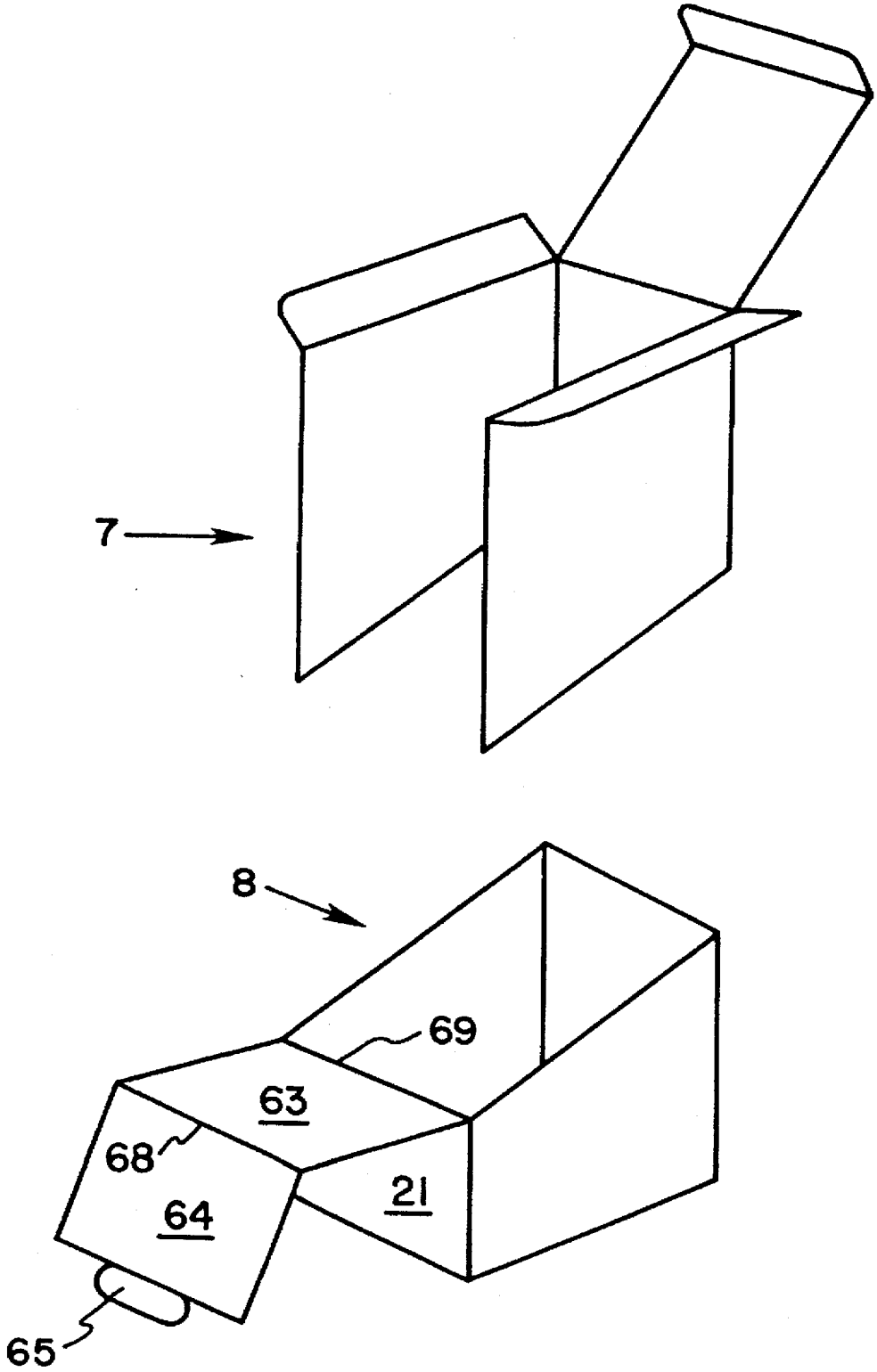
FIGS. 9–11 show an embodiment with a front-folding base configuration.
Figure 9:
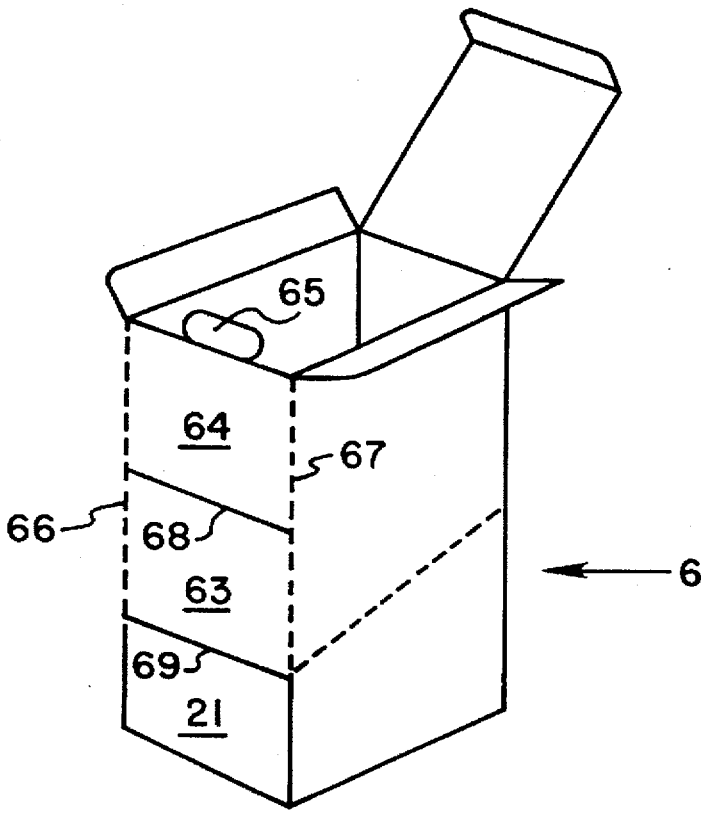
Figure 11:
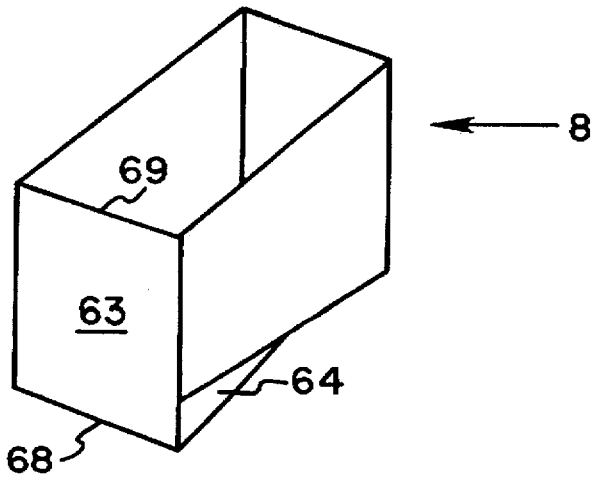

The base for tilting can also be made from panels other than the lid. FIG. 9 shows a carton 6 wherein panel 16 of FIG. 2 is replaced by panels 63 and 64. Panel 63 is attached to panel 21 by fold line 69 and panel 64 is attached to panel 63 by fold line 68. Fold lines 49 and 50 of FIG. 2 become perforated lines 66 and 67 and fold line 34 of FIG. 3 becomes a perforated line. Tab 65 is attached to the top of panel 64. FIG. 10 shows lower portion 8 and upper portion 7 after they are separated. Lower portion 8 is prepared for display as shown in FIG. 11. Panel 63 is folded outwardly and downwardly, panel 64 is folded under the floor of the carton, and tab 65 of FIG. 10 is inserted into a tab slot in the floor. In the final form, panel 63 extends below and substantially perpendicular to the floor of the carton and panel 64 extends diagonally upward and toward the rear of the carton thereby forming a base for tilting the carton toward the rear. Alternatively, the base could be formed in a similar way by folding down the side panels instead of the front panels and utilizing diagonal lines 31 and 32 as fold lines, instead of perforated lines, to provide the desired tilt.

While the invention has been described above with respect to specific embodiments, it will be understood by those of ordinary skill in the art that various changes in form and details may be made therein without departing from the spirit and scope of the invention.

I claim:

1. A carton for shipping and displaying items, comprising:

a lower portion comprising a lower front panel, two lower side panels each attached to said lower front panel, a lower rear panel attached to each of said lower side panels, an upper rear panel hingedly attached to said lower rear panel, and a floor attached to said lower front panel, said lower side panels and said lower rear panel;

an upper portion comprising an upper front panel and two upper side panels attached to said upper front panel, said upper portion separably attached to said lower portion for removal when said carton is used for displaying; and a base panel hingedly attached to said upper rear panel, said base panel and said upper rear panel adapted for folding backward and downward thereby placing said base panel under said lower portion and forming a base for tilting said lower portion.

2. The carton of claim 1 wherein said upper portion and said lower portion are separably attached by a line of perforations.

3. The carton of claim 1 wherein said base panel comprises a lid for said carton when said carton is used for shipping.

4. The carton of claim 1 wherein a rear edge of said base panel is hingedly attached to a top edge of said upper rear panel, and wherein a bottom edge of said upper rear panel is hingedly attached to a top edge of said lower rear panel.

5. The carton of claim 1 further comprising a tab panel hingedly attached to said base panel, a base tab attached to said tab panel, and a tab slot in said floor for receiving said base tab when said base panel is placed under said lower portion.

6. The carton of claim 1 wherein said carton is folded from a blank cut from a flat sheet of material.

7. The carton of claim 6 wherein said material is cardboard.

8. The carton of claim 6 wherein said blank has a finished surface.

9. The carton of claim 8 wherein said finished surface is visible from in front of said carton when said carton is used for displaying.

* * * * *